US010238160B1

(12) United States Patent
Mabon

(10) Patent No.: US 10,238,160 B1
(45) Date of Patent: Mar. 26, 2019

(54) STRAP ADJUSTABLE BRASSIERE

(71) Applicant: Lois Jane Mabon, Landenberg, PA (US)

(72) Inventor: Lois Jane Mabon, Landenberg, PA (US)

(73) Assignee: The Mabon Group LLC, Landenberg, PA (US)

( * ) Notice: Subject to any disclaimer, the term of this patent is extended or adjusted under 35 U.S.C. 154(b) by 0 days.

(21) Appl. No.: 16/053,712

(22) Filed: Aug. 2, 2018

(51) Int. Cl.
*A41C 3/00* (2006.01)
*A41F 15/00* (2006.01)

(52) U.S. Cl.
CPC ..... *A41F 15/002* (2013.01); *A41C 3/00* (2013.01)

(58) Field of Classification Search
CPC ..... A41C 3/00; A41C 3/0028; A41F 15/002
USPC ..... 450/86, 88
See application file for complete search history.

(56) References Cited

U.S. PATENT DOCUMENTS 1,677,109 A 1/1926 Korper
3,179,109 A 4/1965 Born
3,763,865 A * 10/1973 DeFru ..... A41C 3/00 450/41
5,024,628 A 6/1991 Sanchez
5,935,044 A 8/1999 Brewster
5,938,500 A * 8/1999 Hampton ..... A41C 1/06 2/73
6,086,451 A * 7/2000 Fernandes ..... A41F 15/002 2/67
6,098,859 A * 8/2000 Bortner ..... A44B 11/12 224/195
6,575,811 B1 * 6/2003 Fildan ..... A41C 3/0071 450/41
7,507,141 B2 * 3/2009 Ward ..... A41F 15/002 2/69
8,075,369 B2 * 12/2011 Hendrickson ..... A41C 3/0028 450/86
9,615,616 B2 * 4/2017 Corrado ..... A41F 15/002
2010/0297913 A1 * 11/2010 Liegey ..... A41C 3/005 450/39

FOREIGN PATENT DOCUMENTS

GB 2435401 A 8/2007

* cited by examiner

*Primary Examiner* — Gloria Hale
(74) *Attorney, Agent, or Firm* — Invention To Patent Services; Alex Hobson

(57) ABSTRACT

A strap adjustable brassiere has straps that are slidably engaged with a band rail extending along the wing band and/or a cup rail extending along the cup. The wing band rail extends in an incline from a side position toward the center back position and this enables the straps to be slid from one position to another along the band rail without changing the length of the straps. Likewise, the cup rail extends at an incline from a side location toward the center front location to allow the strap to slide along the cup rail without changing the length of the strap. The rail may be a bulbous extension from the wing band and the strap slider may have a cavity that extends around the rail to provide a slidable engagement.

22 Claims, 8 Drawing Sheets

STRAP ADJUSTABLE BRASSIERE

BACKGROUND OF THE INVENTION

Field of the Invention

The invention relates to a strap adjustable brassiere wherein the strap is slidably engaged with the wing band and wherein the top edge of the wing band extends in a decline from a central location to accommodate all adjustment of the strap location without substantially changing the length of the strap.

Background

When a woman changes her garments, such as a top or dress, often times the brassiere she is wearing is not suitable for the new garment as the straps are exposed and not covered by the new garment. For example, a woman may have a wide shoulder shirt or dress and the garment may cover the brassiere straps. However, when the woman puts on a new garment that extends over the woman's shoulders closer to her neck, or a narrow shoulder garment, the brassiere straps become exposed. This requires the woman to change her brassiere or in some cases change the attachment of the brassiere strap to the wing band. Unfortunately, changing the location of the brassiere strap attachment to the wing band requires changing the length of the brassiere strap. This time consuming and difficult as the buckles are small and difficult to manipulate.

SUMMARY OF THE INVENTION

The invention is directed to a strap adjustable brassiere that enables the position of the straps to be changed without changing the length of the straps. The straps extend over the shoulders and are coupled with the wing band. The wing band has a band rail that extends in an in an incline from a side position toward the center of the back and may follow an arc along a portion of the length of the band rail to allow the extended end of the strap and slider configured thereon to slide from one position to another without changing the length of the strap. The band rail extends upward from a side location or location proximal to a woman's side toward a center back location. Likewise, the strap position with respect to the cups may be changed by sliding the straps along cup rail. The cup rail may be inclined from a front-side location toward a center location and this incline may correspond with a shoulder angle, or angle of incline of the shoulder from the shoulder toward the neck.

An exemplary strap adjustable brassiere comprises a front portion with a left and right cup and a wing band that extends from the left and right cups to the back of a wearer of the brassiere. An exemplary strap adjustable brassiere may comprise separate left and right wing bands that are detachably attachable by clasps or other means. An exemplary strap adjustable brassiere may however have a continuous wing band, or wing band that is not detachably attachable and extends continuously from the left cup to the right cup, such as a sports bra. An exemplary strap adjustable brassiere comprises left and right straps that extend from the left and right cups, respectively, over the shoulders of a wearer and are coupled with the wing band along the back of a wearer. The straps may comprise a buckle to adjust the length of the strap, or may be a continuous strap, a strap that does not have a buckle or length adjustment device.

An exemplary strap adjustable brassiere comprise a band rail that extends along a top edge of the wing band. The band rail extends at a decline from a center back location towards a left side location and a right side location and may extend in an arc over a portion of the length of the wing band. The left and right side locations are proximal to the side of wearer along the back of the wearer and may be about 100 mm or more, about 125 mm or more, about 150 mm or more, about 175 mm or more, or about 200 mm or more from the center back location, or center of the wing band along the back. Each of the straps extend over the shoulders of a wearer of the brassiere to an extended end, or coupling end having a band slider that is configured to couple with the band rail in a slidable engagement. The band slider a can be slid along the band rail to change the position of the strap with respect to the wing band without changing the length of the strap.

An exemplary band rail extends along the top edge of the wing band from a center back location to a left side location and from a center back location to a right side location along the wing band. Each of the left and right band sliders may comprise a slider cavity that extends around the band rail to slidably engage the left and right band slider with the band rail. The band rail may have a round cross-section, such as circular or oval in shape, and the slider cavity of the left and right band sliders may be a cylindrical shaped cavity that extends around the band rail. The band rail preferably has a round, circular or oval cross-section shape, and a curved outside surface to allow smooth movement or sliding of a corresponding curved slider cavity. However, the band rail may be rectangular, triangular, irregular shaped and the like.

An exemplary band rail comprises a rail cavity and each of the left and right band sliders comprise a slider insert that extends within the slider cavity to slidably engage the left and right band slider with the band rail. An exemplary rail cavity has a round cross-section, such as circular or oval in shape, and an exemplary slider insert has a round, circular or oval, cylindrical shape to fit within the cross-section of the rail cavity. A band rail having a rail cavity also has a rail slot to allow the strap to couple with and slide along with the slider insert. In addition, a rail slot allows expansion of the band or cup rail to detachably attach the left and right slider inserts.

The band slider and cup sliders may be retained in a position by interference with the band rail and cup rail respectively. The geometries of the sliders with the rail may secure the sliders in place but allows them to be slid from one position to another with a suitable force. The band and/or cup rails may be made of a fabric and the band/or cup sliders may be made from a plastic material, such as a molded plastic part. In an exemplary embodiment, the band and cup rails comprise a fabric and have a cross-section that is slightly larger than the cavity cross-section of the band and cup sliders, respectively. The rail may comprise a resilient material covered by a fabric, for example. A resilient material, such as a foam or fabric, can be deformed from an original shape and will recover to said original shape after removal of a deforming force or load. The band and cup rails may be compressible and resilient, whereby they can be compressed to fit within the slider cavity. In this way, the slider, having a slider slot, can be secured around the rail and slid to a new position and retained in said new position by the interference fit between the slider cavity and the rail. In another embodiment, the rails, cup and band, have a rail cavity, wherein the rail cavity is made of a plastic, such as a molded plastic part, and the slider insert, cup and band, may be made of a fabric that is slightly larger in cross-sectional dimension than the cavity. The slider may be inserted into the rail cavity through the rail slot and is secured in a position by the interference fit between the slider insert and rail cavity.

An exemplary strap adjustable brassiere has strap adjustment features to enable changing the position of the straps with respect to the cups. An exemplary strap adjustable brassiere has a cup rails on each of the left and right cups and the cup rails extend at an incline toward a center of the front portion. An exemplary strap adjustable brassiere has left and right straps that each comprise a cup slider that is slidably engaged with the cup rail. The position of the left and right straps with respect to the left and right cups can be changed by sliding cup sliders along the cup rail without changing the length of the straps.

An exemplary strap adjustable brassiere enables changing a position of a brassiere strap without changing the length of the brassiere strap. The method of changing the position of the straps comprises first donning the exemplary strap adjustable brassiere and then sliding the sliders, cup or band, along the cup rail or band rail, respectively, to change a strap position.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
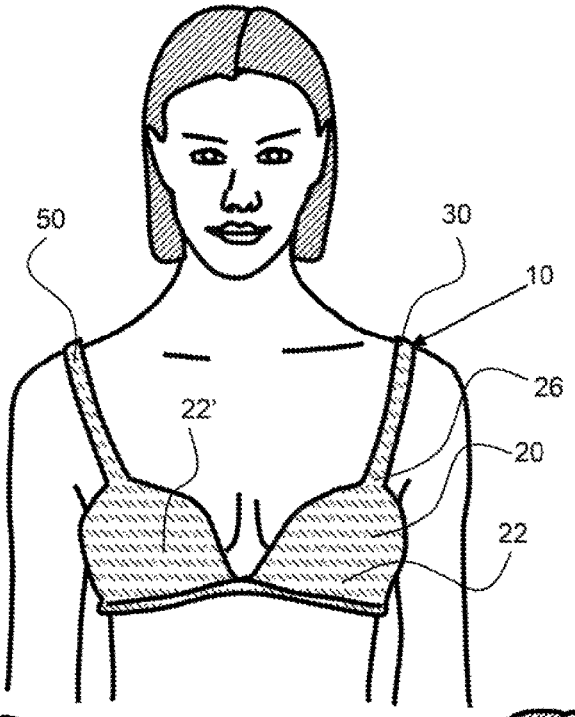
FIG. 1 shows a front view of an exemplary strap adjustable brassiere of the present invention.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

A round cross-section, as used herein includes circular and oval and it is to be understood that the rail and slider are coupled to the brassiere wing band, cup or strap, respectively, and therefore the cross-sectional shape is not continuous in the area of connection.

As shown in FIG. 1, an exemplary strap adjustable brassiere 10 has a front portion 20 comprising a pair of cups 22, 22' to support a woman's breasts. A left strap 30 extends from the left cup 22 over the woman's left shoulder and a right strap 50 extends from the right cup 22' over the woman's right shoulder. Note that the straps extend relatively wide over the woman's shoulders.

Figure 2:
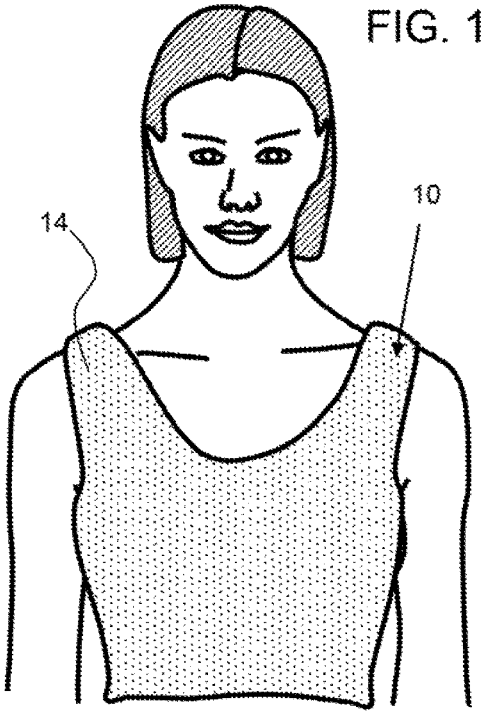
FIG. 2 shows a front view of a women wearing a wide shoulder shirt over an exemplary strap adjustable brassiere with the straps being concealed under the shirt.

As shown in FIG. 2, a woman is wearing a wide shoulder shirt 14, a shirt that extends over a portion of the shoulder distal from woman's neck. The wide shoulder shirt extends over an exemplary strap adjustable brassiere 10 with the straps being concealed under the shirt.

Figure 3:
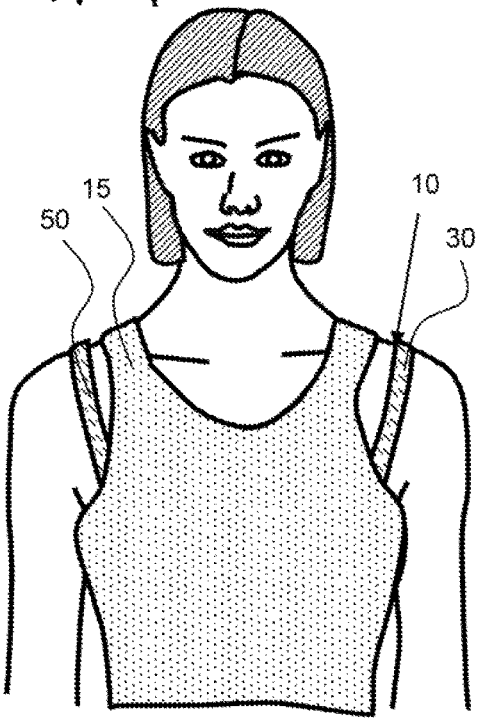
FIG. 3 shows a front view of a woman wearing a narrow shoulder shirt over an exemplary strap adjustable brassiere with the straps exposed.

As shown in FIG. 3, the woman is now wearing a narrow shoulder shirt 15, a shirt that covers only the portion of the shoulder proximal to woman's' neck. The narrow shoulder shirt does not cover the straps 30, 50 of the exemplary strap adjustable brassiere. A portion of the left and right straps are exposed. As described herein, the woman can easily adjust the position of the straps without changing the length of the straps to conceal the straps under the narrow shoulder shirt.

Figure 4:
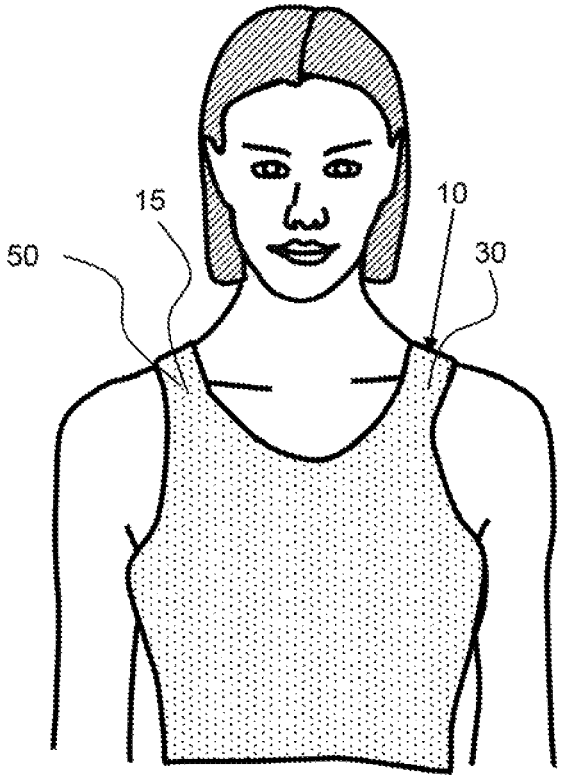
FIG. 4 shows a front view of a women wearing a narrow shoulder shirt over an exemplary strap adjustable brassiere with the straps moved from the position shown in FIG. 3 to conceal the straps under the shirt.

As shown in FIG. 4, the position of the straps has been changed from the position shown in FIG. 3. The position of the straps may be changed along the band rail and/or along the cup rail to conceal the straps 30, 50, under the shirt.

Figure 5:
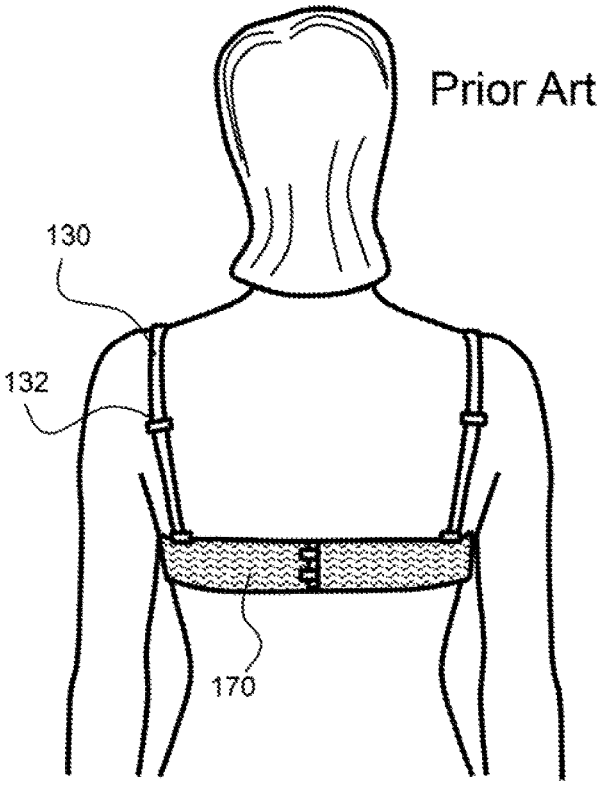
FIGS. 5 and 6 show a back view of a conventional brassiere with clips that couple the straps to the wing band and wherein the length of the strap has to be changed to allow changing the location of the strap connection with the wing band.
Figure 6:
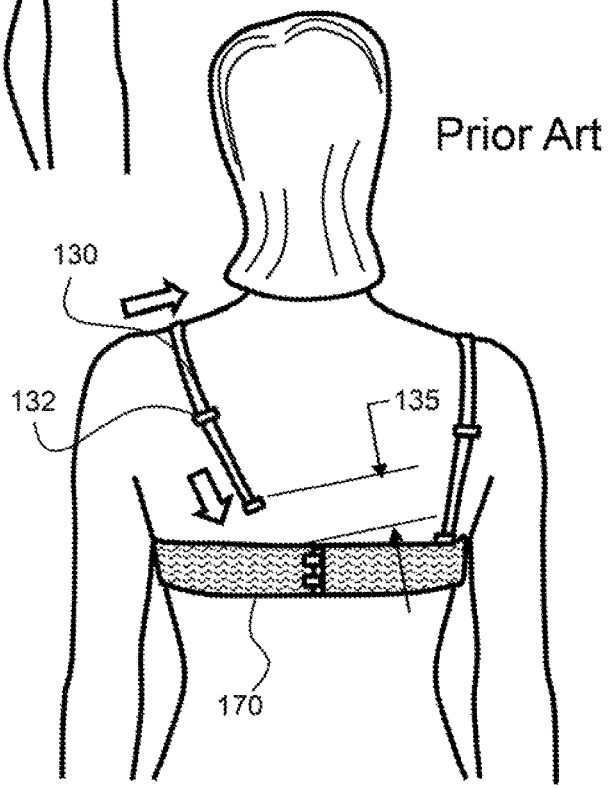

As shown in FIGS. 5 and 6, a conventional brassiere with clips that couple the straps to the wing band may be used to adjust the position the straps with respect to the wing band, to conceal the narrow shoulder shirt, for example. As shown in FIG. 6, the left strap 130 has been unclipped from the wing band 170 but will be too short to extend to a more central location on the wing band. The left strap will be too short to extend to a central back location. An extension distance 135 will be required to extend the strap to the desired location. The left strap buckle 132 will have to be used to extend the length of the strap to enable movement to the central location. This may require taking the brassiere off to adjust the length of the straps.

Figure 7:
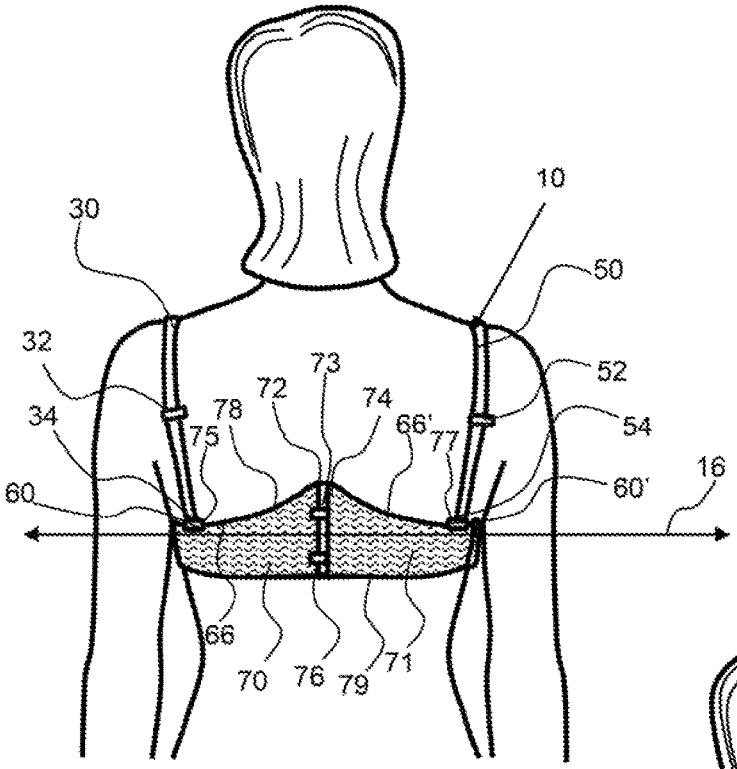
FIGS. 7 and 8 show a back view of an exemplary strap adjustable brassiere with sliders slidably engaged with the band rail of the wing band to allow changing the location of the extended end of the strap, or slider without changing the length of the strap, wherein the band rail of the wing band extend upward toward a center location.
Figure 8:
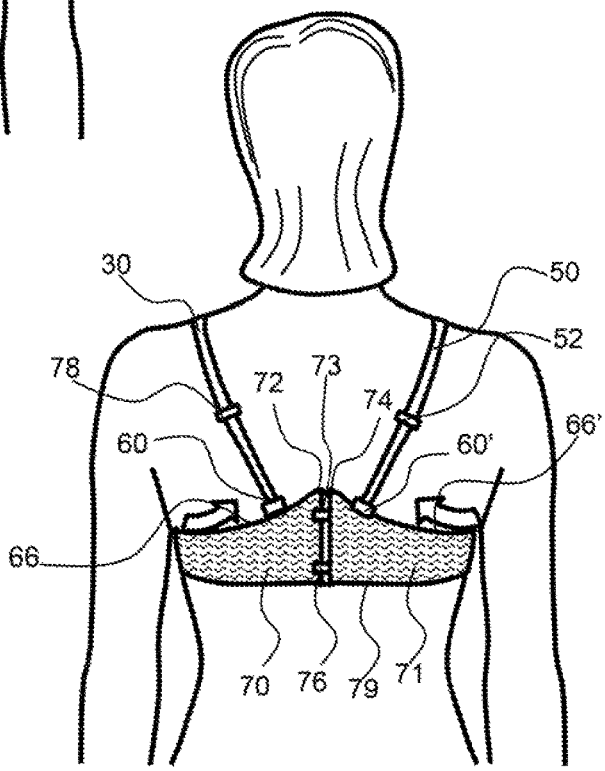

As shown in FIGS. 7 and 8, an exemplary strap adjustable brassiere 10 has band sliders 60, 60' that are slidably engaged with the band rail 66, 66', respectively. The band sliders are configured along top edge 78 of the wing band 70 to allow changing the location of the coupling ends or extended ends 34, 54, of the straps 30, 50 respectively, without changing the length of the strap. The band slider and the top edge 78 of the wing band extend upward toward a center location or put another way, extend downward from the central back location 73. As the band slider is slid from a side location 75, 77, a position distal from the center back location or proximal to a side of a person wearing the strap adjustable brassiere 10, toward the center back location 73, the band rail inclines upward, such as along an arc, to allow the strap to slide without a substantial change in strap length. The wing band comprises a left wing band 70 and right wing band 71 that extend to extended ends, 72, 74, respectively. The left wing band and right wing band are detachably attached together by a clasp 76 or clasps. The bottom edge 79 of the wing band may extend horizontally, or substantially parallel with a horizontal axis 16, when the brassiere is worn by a woman standing vertically.

Figure 9:
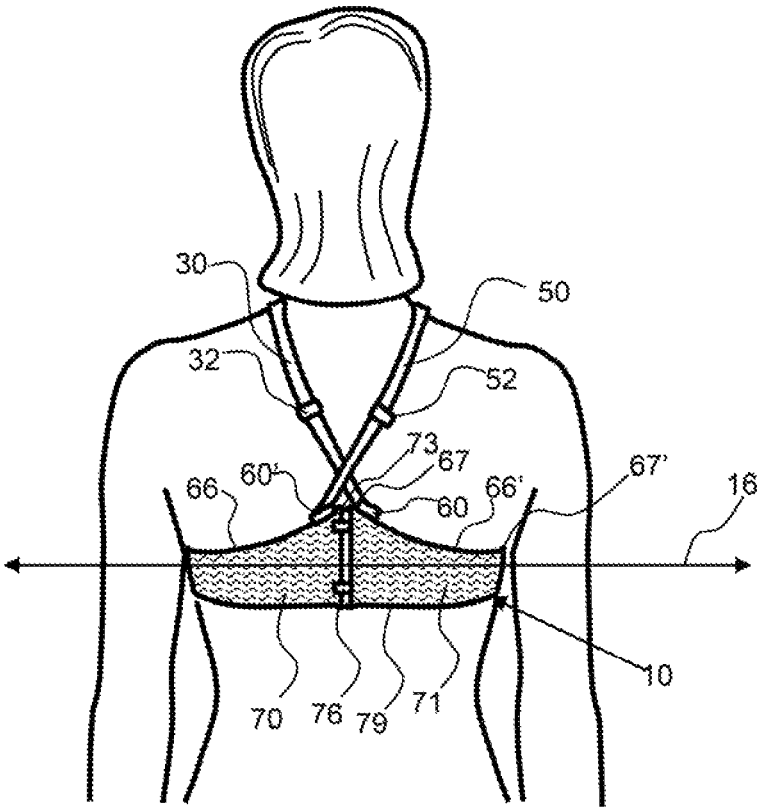
FIG. 9 shows a back view of an exemplary strap adjustable brassiere with left band slider engaged with the right wing band and the right band slider engaged with the left wing band.

FIG. 9 shows a back view of an exemplary strap adjustable brassiere with the left band slider 60 coupled to the right wing band 71 and the right band slider 60' engaged with the left wing band 70. The band sliders 60 may be detachably attachable to the band rail 66, such as by sliding them off of the band rail extended end 67 proximal to the center 73 of the back portion, or an extended end 67' proximal to side of the back portion or extended from the center of the back portion. Note that both the left and right wing band may have an extended end of the band rail. The straps 30 and 50 may be detachably attachable to the band sliders and the band sliders may be affixed to their respective cup rails and not be detachable. This would enable the straps to be crossed without removal of the band sliders, which may facilitate switching between configurations. A detachably attachable strap may enable a more secure attachment of the band slider to the band rail, to prevent undesirable detachment. The band slider may be a rigid material that is not readily detached from the band rail by pulling. This configuration may be better suited for athletic brassieres wherein a lot of force may be applied to the straps when running or jumping. A strap may comprise a loop that extends over a post attached to the band sliders to detachably attach the strap to the band slider. Any suitable attachment feature may be configured between the strap and the band slider including, but not limited to, a clip, buckle, hook and loop fastener, snap and the like.

Figure 10:
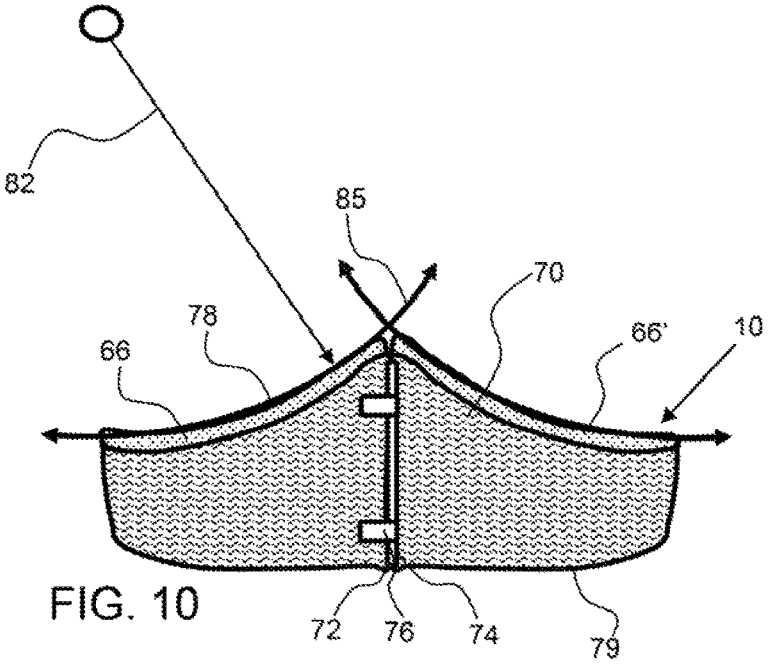
FIG. 10 shows a wing band of an exemplary strap adjustable brassiere having a band rail or top edge that extends in an arc over a portion of the length of the band rail.

As shown in FIG. 10, a wing band 70 of an exemplary strap adjustable brassiere 10 has a band rail 66 that extends in an arc 85, having a radius 82, over a portion of the length of the wing band or top edge of the wing band. The band rail may extend a length from a center back location to a side location, or a location proximal to a user's side when the brassiere is worn. The center of the arc, or pivot point, may correspond with a point along the shoulder of a wearer of an exemplary strap adjustable brassiere.

Figure 11:
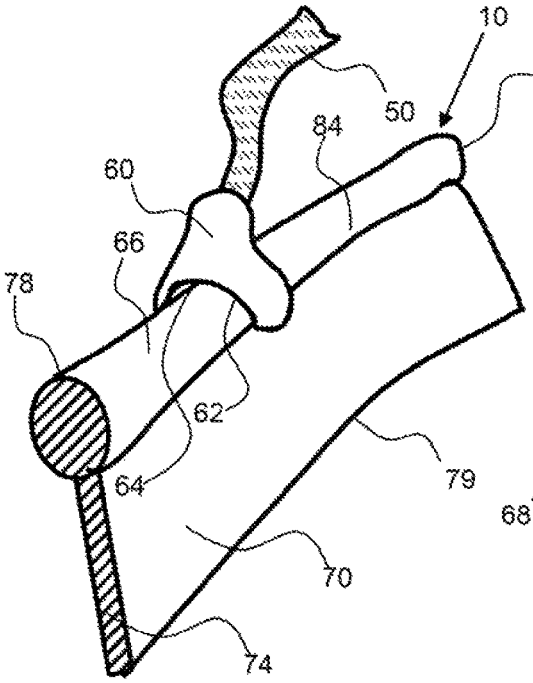
FIG. 11 shows a slider having a slider cavity engaged around a rail of an exemplary strap adjustable brassiere.

As shown in FIG. 11, a band slider 60, is engaged with a band rail 66. The band slider slot 64 has a slider cavity 62 that extends around the band rail 66. The slider slot and cavity may be slid over an extended end 67 of the band rail, or expanded outward to fit around the band rail, wherein the band slider snaps back to fit around the band rail to secure the band slider to the band rail. As described herein the band rail may be slightly larger than the slider cavity to provide an interference fit to secure the slider and strap in a desired location along the band rail. The exemplary band rail is round in cross-section, having a substantially circular shape except where the band rail is coupled with the wing band, and the band rail has a curved outside surface 84. The band slider has a circular slider cavity 62, that is cylindrical in shape, having an opening that enables the band slider to extend around the band rail to allow slidable engagement with the band rail. The band rail is configured along the top edge 78 of the wing band 70. The position of the strap 50 may be changed with respect to the wing band by sliding the band slider along the band rail. Note that this configuration may be configured on cup rail, wherein the cup slider has a slider cavity that extends around the cup rail.

Figure 12:
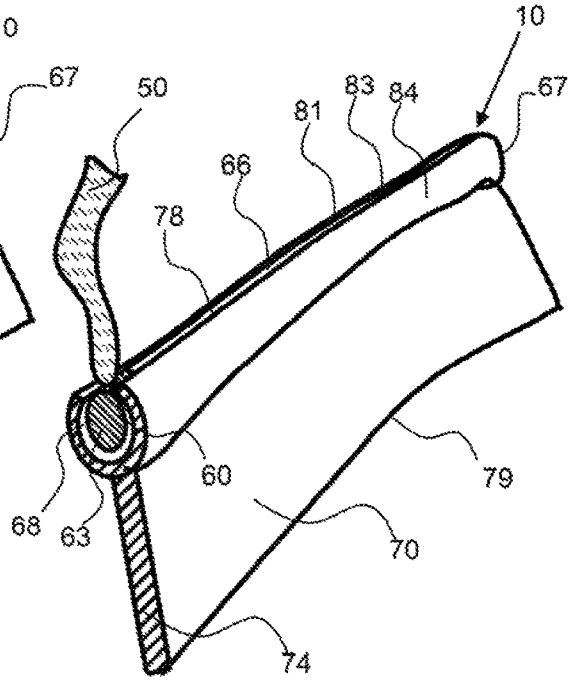
FIG. 12 shows a slider having a slider insert engaged with a rail cavity of an exemplary strap adjustable brassiere.

As shown in FIG. 12, a band slider 60 comprises a slider insert 63 that is engaged with a rail cavity 68 of a band rail 66. The exemplary rail cavity is circular in cross-section and has curved inside surface 83. The slider insert 63 has a cylindrical shape, to allow it to slide within the rail cavity. The rail cavity has a rail slot 81 to allow the strap 50 to be coupled with the slider insert to enable the position of the strap to be changed with respect to the wing band 70 by sliding the slider insert within the rail cavity. The rail slot may also allow the slider insert to be detachably attached to the rail cavity by expanding open to allow the insertion of the slider insert. Alternatively, the slider insert may be slid into the band rail opening at the extended end 67. The band rail may open to expand the slider slot to allow insertion and removal of the slider insert. Note that this configuration may be configured on cup rail, wherein the cup rail has a rail cavity and the cup slider has a slider insert.

Figure 13:
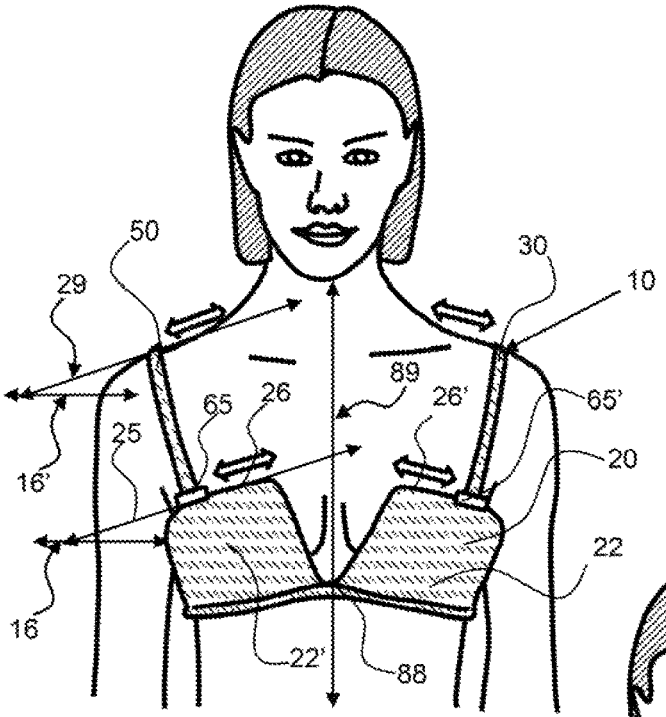
FIGS. 13 and 14 show a front view of an exemplary strap adjustable brassiere having the cup sliders engaged with cup rail extending along a top edge of the cup portion of the brassiere.
Figure 14:
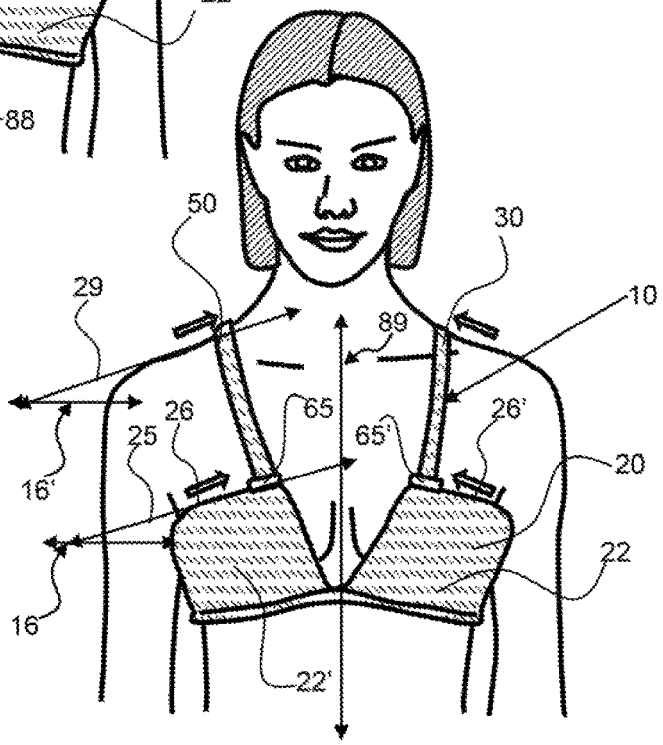

As shown in FIGS. 13 and 14, an exemplary strap adjustable brassiere 10 comprises a cup rails 26, 26' that extends at a cup angle 25 that is inclined from a horizontal axis 16 towards the center 88 of the front portion 20 of the brassiere, or toward the vertical centerline 89. The cup angle may be substantially the same as the incline of the shoulder, or shoulder angle 29, that is also inclined from a side or shoulder location toward the neck of the woman, as measured from a horizontal axis 16'. The cup rails are engaged with the cup sliders 65, 65' to allow the position of the strap to be changed with respect to the cup without changing the length of the strap. As shown in FIG. 13, the strap is in an outside or wide position with respect to the woman's shoulder. As shown in FIG. 14, the straps have been slid toward the center of the front portion 20 of the brassiere without changing the length of the straps. The shoulder angle and cup angles are substantially parallel or within about 20 degrees of parallel each other.

Figure 15:
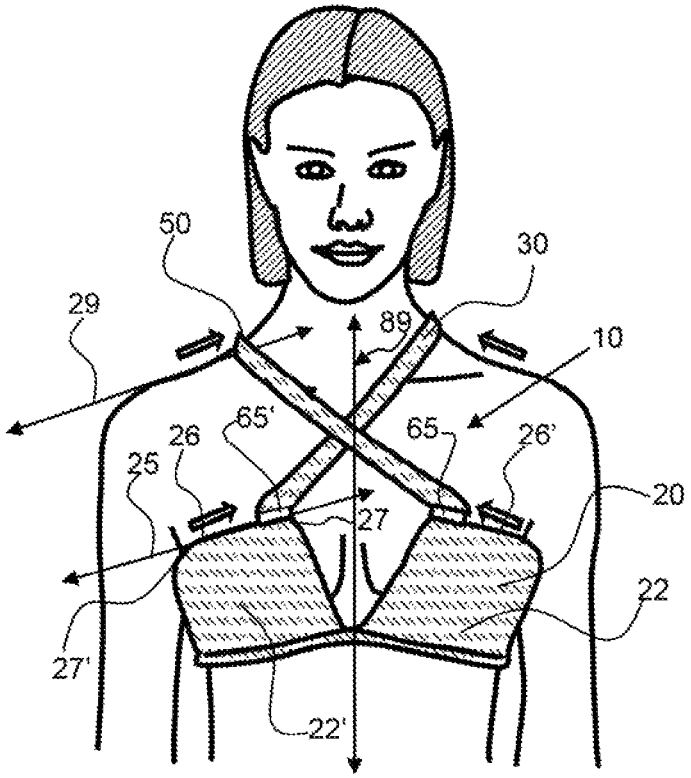
FIG. 15 shows a front view of an exemplary strap adjustable brassiere having the left and right straps crossed to engage the right cup slider on the left cup rail and the left cup slider with the right cup rail.

As shown in FIG. 15, an exemplary strap adjustable brassiere 10 has the left strap 30 and right strap 50 crossed to engage the right cup slider 65 on the left cup rail 26' and the left cup slider 65' with the right cup rail 26. The cup sliders may be detachable from the cup rail, such as by sliding off an extended end 27 of the cup rail such as the extended end 27 proximal the center of the front portion or the extended end proximal the side 27'. This configuration may enable the brassiere to accommodate halter tops, wherein the straps will not show when wearing a halter top. The straps 30 and 50 may be detachably attachable to the cup sliders and the cup sliders may be affixed to their respective cup rails and not be detachable. This would enable the straps to be crossed without removal of the band sliders, which may facilitate switching between configurations. A detachably attachable strap may enable a more secure attachment of the cup slider to the cup rail, to prevent undesirable detachment. The cup slider may be a rigid material that is not readily detached from the cup rail by pulling. This configuration may be better suited for athletic brassieres wherein a lot of force may be applied to the straps when running. A strap may comprise a loop that extends over a post attached to the cup sliders to detachably attach the strap to the cup slider. Any suitable attachment feature may be configured between the strap and the cup slider including, but not limited to, a clip, buckle, hook and loop fastener, snap and the like.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An adjustable strap brassiere comprising:

a) a front portion with a left cup and a right cup b) a wing band extending from the front portion horizontally and configured to extend around a torso of a user to a back of said user;

said wing band comprising:

i) a band rail extending along a top edge of the wing band;

wherein the band rail extends at a decline from a center back location of the wing band towards a left side location and a right side location of the wing band;

wherein the center back location of the wing band is configured to be centrally located along the back of said user when the adjustable strap brassiere is worn by said user;

c) a left strap extending from the left cup and configured to extend over a left shoulder of a user to a coupling end having a left band slider that is slidably engaged with the band rail of the wing band;

wherein the left band slider is slidable along the band rail to change a position of the coupling end of the left strap with respect to the wing band without changing a length of the left strap;

d) a right strap extending from the right cup and configured to extend over a right shoulder of a user to a coupling end having a right band slider that is slidably engaged with the band rail of the wing band; and wherein the right band slider can be slid along the band rail to change a position of the coupling end of the right strap with respect to the wing band without changing a length of the right strap.

2. The adjustable strap brassiere of claim 1, wherein the band rail extends in an arc from the center back location of the wing band down toward the left side location and from said center back location of the wing band down toward the right side location.

3. The adjustable strap brassiere of claim 1, wherein band rail extends along the top edge of the wing band from a center back location of the wing band to a left side location and from a center back location to a right side location along the wing band; and wherein each of the left and right band sliders comprise a slider cavity that extends around the band rail to slidably engage the left and right band slider with the band rail.

4. The adjustable strap brassiere of claim 3, wherein the band rail has a round cross-section and wherein the slider cavity of the left and right strap slider is cylindrical shaped to extend around the band rail.

5. The adjustable strap brassiere of claim 1, wherein the band rail extends along the top edge of the wing band from a center back location of the wing band to a left side location and from a center back location to a right side location along the wing band; and wherein the band rail comprises a rail cavity; and wherein each of the left and right strap sliders comprise a slider insert that extends within the rail cavity to slidably engage the left and right strap slider with the band rail.

6. The adjustable strap brassiere of claim 5, wherein the rail cavity has a round cross-section and wherein the slider insert is cylindrical in shape to fit within the cross-section of the slider cavity.

7. The adjustable strap brassiere of claim 6, wherein the rail slot expands to detachably attach the left and right strap sliders from the slider cavity.

8. The adjustable strap brassiere of claim 1, wherein the left and right strap sliders are detachably attachable to the band rail.

9. The adjustable strap brassiere of claim 1, wherein the wing band is a continuous wing band.

10. The adjustable strap brassiere of claim 9, wherein the left and right straps are continuous straps.

11. The adjustable strap brassiere of claim 1, wherein the wing band comprises:

a) a left wing band is configured to extend from the left cup horizontally around a torso of a user to a left extended end;

b) a right wing band is configured to extend from the right cup horizontally around a torso of a user to a right extended end;

c) a clasp on one of the left or right extended ends to detachably attach the left and right wing bands together.

12. The adjustable strap brassiere of claim 1, wherein each of the left strap and the right strap comprise a buckle to change the respective length of the strap.

13. The adjustable strap brassiere of claim 1, further comprising a cup rail on each of the left and right cups; and wherein the cup rail extends at an incline toward a center of the front portion; and wherein the left and right straps each comprise a cup slider that is slidably engaged with the cup rail; and wherein a position of the left and right straps with respect to the left and right cups is adjustable by sliding the cup slider along the cup rail, without changing the length of the strap.

14. A method of changing a position of a brassiere strap without changing a length of the brassiere strap comprising the steps of:

a) providing an adjustable strap brassiere comprising:

i) a front portion with a left cup and a right cup;

ii) a wing band is configured to extend from the front portion horizontally around a torso of a user to a back of said user;

said wing band comprising:

a band rail extending along a top edge of the wing band;

wherein the band rail extends at a decline from a center back location towards a left side location and a right side location;

iii) a left strap extending from the left cup and configured to extend over a left shoulder of a user to a coupling end having a left strap slider that is slidably engaged with the band rail of the wing band;

wherein the left band slider can be slid along the band rail to change a position of the coupling end of the left strap with respect to the wing band without changing a length of the left strap;

iv) a right strap extending from the right cup and configured to extend over a right shoulder of a user to a coupling end having a right strap slider that is slidably engaged with the band rail of the wing band;

wherein the right band slider can be slid along the band rail to change a position of the coupling end of the right strap with respect to the wing band without changing a length of the right strap; and b) donning the adjustable strap brassiere on a person;

c) sliding the left strap slider along the band rail to change a position of the coupling end of the left strap with respect to the wing band without changing the length of the left strap; and d) sliding the right strap slider along the band rail to change a position of the coupling end of the right strap with respect to the wing band without changing the length of the left strap.

15. The method of changing a position of a brassiere strap without changing a length of the brassiere strap of claim 14, wherein the band rail extends in an arc from the center back location of the wing band down toward the left side location and from the center back location down toward the right side location.

16. The method of changing a position of a brassiere strap without changing a length of the brassiere strap of claim 14, wherein the band rail extends along the top edge of the wing band from a center back location to a left side location and from a center back location of the wino band to a right side location along the wing band; and wherein each of the left and right strap sliders comprise a slider cavity that extends around the band rail to slidably engage the left and right band rail with the band rail.

17. The method of changing a position of a brassiere strap without changing a length of the brassiere strap of claim 16, wherein the band rail has a round cross-section and wherein the slider cavity of the left and right strap sliders has a cylindrical shaped cavity that extends around the band rail.

18. The method of changing a position of a brassier strap without changing a length of the brassiere strap of claim 14, wherein the wing band is a continuous wing band and wherein the left and right straps are continuous straps.

19. The method of changing a position of a brassiere strap without changing a length of the brassiere strap of claim 14, wherein the adjustable strap brassiere further comprises a cup slider on each of the left and right cups; and wherein the cup sliders extend at an incline toward a center of the front portion; and wherein the left and right straps each comprise a cup slider that is slidably engaged with the cup slider; and wherein the method further comprises:

changing a position of the left and right cup slider with respect to the cup sliders without changing a length of the strap.

20. The method of changing a position of a brassiere strap without changing a length of the brassier strap of claim 19, wherein each of the left and right cup sliders comprise a cup-slider cavity that extends around the cup rail to slidably engage the left and right cup slider with the cup rail; and wherein the cup rail has a round cross-section and wherein the cup-slider cavity of the left and right cup slider is cylindrical shaped to extend around the cup rail.

21. The method of changing a position of a brassiere strap without changing a length of the brassiere strap of claim 19, wherein the left and right cup sliders are detachably attachable to the cup rail.

22. The method of changing a position of a brassiere strap without changing a length of the brassiere strap of claim 21, wherein the left and right strap sliders are detachably attachable to the band rail.

* * * * *